US007210229B2

(12) United States Patent
Coffin

(10) Patent No.: US 7,210,229 B2
(45) Date of Patent: May 1, 2007

(54) RAZOR CARTRIDGE

(75) Inventor: David Coffin, Hamden, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 203 days.

(21) Appl. No.: 10/374,413

(22) Filed: Feb. 26, 2003

(65) Prior Publication Data

US 2003/0217469 A1 Nov. 27, 2003

Related U.S. Application Data

(63) Continuation-in-part of application No. 10/132,536, filed on Apr. 24, 2002, now abandoned.

(51) Int. Cl.
*B26B 21/22* (2006.01)

(52) U.S. Cl. ..... 30/50; 30/346.57

(58) Field of Classification Search ..... 30/50, 30/346.5, 346.57, 48

See application file for complete search history.

(56) References Cited

U.S. PATENT DOCUMENTS

| | | | | | |
|---|---|---|---|---|---|
| 1,920,711 | A | | 8/1933 | Pelizzola | |
| 3,660,893 | A | | 5/1972 | Welsh | |
| 3,786,563 | A | * | 1/1974 | Dorion et al. | 30/50 |
| 4,069,580 | A | | 1/1978 | Emmett | |
| 4,146,958 | A | | 4/1979 | Chen | |
| 4,170,821 | A | | 10/1979 | Booth | |
| 4,200,976 | A | | 5/1980 | Gooding | |
| 4,345,374 | A | | 8/1982 | Jacobson | |
| 4,407,067 | A | * | 10/1983 | Trotta | 30/50 |
| 4,443,940 | A | * | 4/1984 | Francis et al. | 30/50 |
| 4,562,644 | A | * | 1/1986 | Hitchens | 30/41 |
| 4,831,731 | A | * | 5/1989 | Elits | 30/50 |
| 5,056,222 | A | | 10/1991 | Miller et al. | |
| 5,141,694 | A | | 8/1992 | Butlin et al. | |
| 5,249,361 | A | | 10/1993 | Apprille | |
| 5,402,574 | A | * | 4/1995 | Milner | 30/41.5 |
| 5,522,137 | A | * | 6/1996 | Andrews | 30/50 |
| 5,524,346 | A | * | 6/1996 | Backhaus | 30/34.2 |
| 5,661,907 | A | | 9/1997 | Apprille | |
| 5,689,883 | A | | 11/1997 | Ortiz et al. | |
| 5,711,076 | A | | 1/1998 | Yin et al. | |
| 5,813,119 | A | | 9/1998 | Ferraro et al. | |
| 5,893,213 | A | | 4/1999 | Motta | |
| 5,953,824 | A | | 9/1999 | Ferraro et al. | |

(Continued)

FOREIGN PATENT DOCUMENTS

| | | | |
|---|---|---|---|
| EP | 1252982 A | | 10/2002 |
| WO | WO 97/33728 | | 9/1997 |
| WO | WO-9939883 | * | 8/1999 |
| WO | WO-9950035 | * | 10/1999 |
| WO | WO 00/37227 | | 6/2000 |

*Primary Examiner*—Stephen Choi
(74) *Attorney, Agent, or Firm*—Michaud-Duffy Group LLP

(57) ABSTRACT

In a razor cartridge, a frame has an opening defined in part by a leading surface and a trailing surface. Positioned within the opening are a plurality of cutting edges, each cutting edge defined by a blade. In a shaving operation, a hirsute surface contacts in turn the leading surface, cutting edges, and the trailing surface. A contact plane is defined between the leading surface and the trailing surface that provides a reference for determining whether a cutting edge has a neutral, positive, or negative exposure. All of the cutting edges within the razor cartridge have an exposure relative to the contact plane that is one of all positive or all negative.

12 Claims, 3 Drawing Sheets

U.S. PATENT DOCUMENTS

| | | | | |
|---|---|---|---|---|
| 5,966,822 | A | 10/1999 | Coffin | |
| 6,026,577 | A | 2/2000 | Ferraro | |
| D424,744 | S | 5/2000 | Coffin | |
| 6,112,412 | A | 9/2000 | Richard | |
| 6,122,826 | A | 9/2000 | Coffin | |
| 6,138,361 | A | 10/2000 | Richard | |
| 6,212,777 | B1 | 4/2001 | Gilder et al. | |
| 6,216,349 | B1 | 4/2001 | Gilder | |
| 6,266,884 | B1 * | 7/2001 | Prochaska | 30/50 |
| 6,276,062 | B1 | 8/2001 | Prochaska | |
| 6,378,211 | B1 | 4/2002 | Wonderley | |
| 6,430,818 | B1 * | 8/2002 | Wonderley | 30/346.57 |
| 6,550,141 | B1 * | 4/2003 | Rivers et al. | 30/50 |
| 6,568,084 | B2 * | 5/2003 | McCool et al. | 30/50 |
| 2003/0154832 | A1 * | 8/2003 | Guimont et al. | 83/13 |
| 2004/0025350 | A1 * | 2/2004 | Richard et al. | 30/50 |

* cited by examiner

RAZOR CARTRIDGE

CROSS REFERENCE TO RELATED APPLICATION

This is a continuation-in-part of application Ser. No. 10/132,536 filed Apr. 24, 2002, now abandoned the disclosure of which is herein incorporated by reference.

FIELD OF THE INVENTION

The invention is generally directed to a wet-shave razor cartridge, and more specifically to a wet-shave razor cartridge having multiple razor blades.

BACKGROUND OF THE INVENTION

The comfort and performance provided by a particular razor is critical to the commercial success of that razor. Modern safety razors used in wet shaving operations to cut hair on hirsute surfaces typically are available in two types—a replaceable having a handle that uses a disposable razor cartridge, or a disposable having a handle combined with a razor cartridge such that the razor cartridge cannot be removed from the handle without destruction of one, the other or both. There are many design similarities between the razor cartridges used in each razor type.

Generally, the razor cartridge contains a number of blades with each blade defining a cutting edge; employing a plurality of cutting edges increases the shaving efficiency of the razor by increasing the number of times any one hair is cut in a single pass thereby decreasing the number of strokes necessary to satisfactorily shave a particular hirsute surface. The fewer number of strokes required over any given surface, the less the potential for irritation of that surface.

The typical multi-blade razor cartridge includes a frame that supports two or more razor blades. A typical frame can be of a single formed piece of plastic or can be any number of assembled parts. The frame typically provides a leading surface and a trailing surface to which the cutting edges are generally parallel. In use, the hirsute surface being shaved contacts in turn the leading surface, the cutting edges of the blades, and the trailing surface.

The leading surface and the trailing surface are generally at opposite sides of an opening defined by the frame in which at least a portion of the cutting edges are exposed. The leading and the trailing surfaces can be used to define a plane that extends over the opening and is approximately tangent to the leading and trailing surfaces. This plane is referred to by those skilled in the art to which the invention pertains, as a "contact plane" and is used as a reference for both qualifying and quantifying the exposure of a cutting edge.

With reference to the contact plane, a cutting edge can be qualified as having an exposure that is neutral, positive, or negative. A cutting edge has a neutral exposure if the entire cutting edge is on the contact plane. A cutting edge has a negative exposure if it is neither on nor extends through the contact plane. Similarly, if a cutting edge extends through the contact plane, its exposure is positive.

Historically, cutting edge exposure has been neutral, however, this does not necessarily render the closest shave at an acceptable comfort level. Accordingly, it is the general object of the present invention to provide a razor cartridge that improves upon or eliminates the problem associated with the prior art.

SUMMARY OF THE INVENTION

The present invention is directed in one aspect to a razor cartridge having a frame. The frame has an opening defined in part by a leading surface and a trailing surface, which cooperate to define a contact plane tangential thereto and extending across the opening. At least two razor blades, each having a cutting edge, are coupled to the frame with each cutting edge positioned at least in part in the opening. All of the cutting edges either have a common positive cutting edge exposure or a common negative cutting edge exposure.

In accordance with the present invention, the distance from the contact plane with regard to a set of blades all having either a positive or a negative exposure can vary from blade to blade. Alternatively, the distance from the contact plane can be constant for each cutting edge. Moreover, the distance from the contact plane can vary from blade-to-blade in accordance with a linear or non-linear function.

In an embodiment of the present invention, at least one blade is angularly offset or skewed relative to another blade. Skewed blades can provide for more effective wash through and thereby debris removal than parallel blades. While one blade has been described as being skewed relative to other blades, the present invention is not limited in their regard as any number, or all of the blades can be skewed without departing from the broader aspects of the present invention.

DETAILED DESCRIPTION OF THE PREFERRED EMBODIMENT

Figure 1:
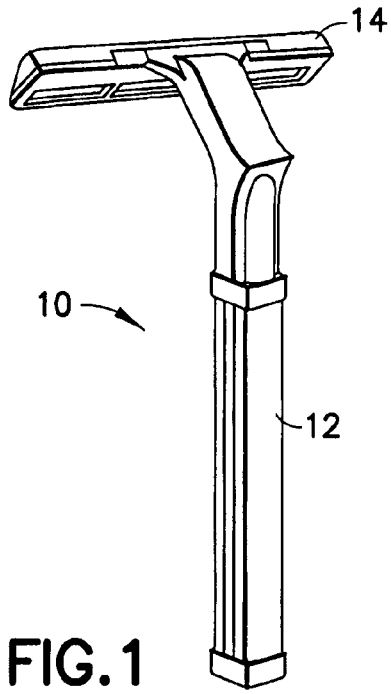
FIG. 1 is a perspective view of a razor.
Figure 2:
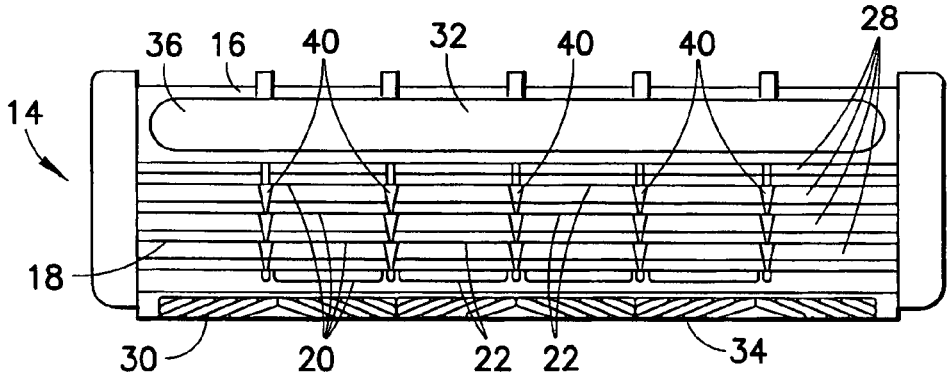
FIG. 2 is a top view of a razor cartridge.
Figure 3:
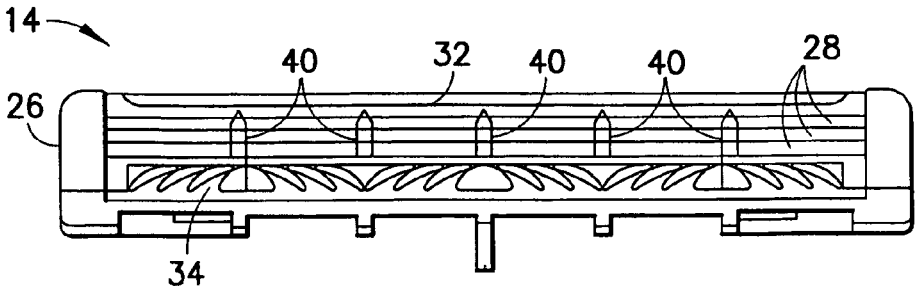
FIG. 3 is a diagrammatic front view of a razor cartridge.

As shown in FIG. 1, a wet shaving razor, generally referred to by the reference number 10, includes a handle 12 coupled to a razor cartridge 14. The coupling can either be temporary or permanent; the razor 10 is either a replaceable or disposable. In either case, the razor cartridges 14 employed are generally similar.

As shown in FIGS. 2 through 5, the razor cartridge 14 includes a frame 16 having a number of razor blades 20 (four in FIG. 4 and five in FIG. 5), coupled thereto. The frame 16 defines an opening 18 wherein a portion of cutting edges 22 defined by each razor blade 20 are exposed. The frame 16 includes a base 24 that defines a plurality of slots 26 that are separated by spacers 28. Each slot 26 is sized to hold a razor blade 20 at the orientation required and to space the cutting edges 22 one from the other.

The frame 16 has a leading surface 30 and a generally opposite trailing surface 32. During a shaving operation, a hirsute surface contacts in turn the leading surface 30, the cutting edges 20, and the trailing surface 32. The leading surface 30 is defined by a guard 34 and the trailing surface 32 is defined by a guard 36, where both the cap and the guard are mounted to the base 24. While the frame 16 has been shown and described as including a cap 36 and a base 24, the present invention is not limited in this regard. For example, the cap 36 could be replaced by a comfort strip. In addition, the cap 36 and the guard 34 could be molded into the frame 16 and not be separate parts to be attached to a base 24.

Figure 4:
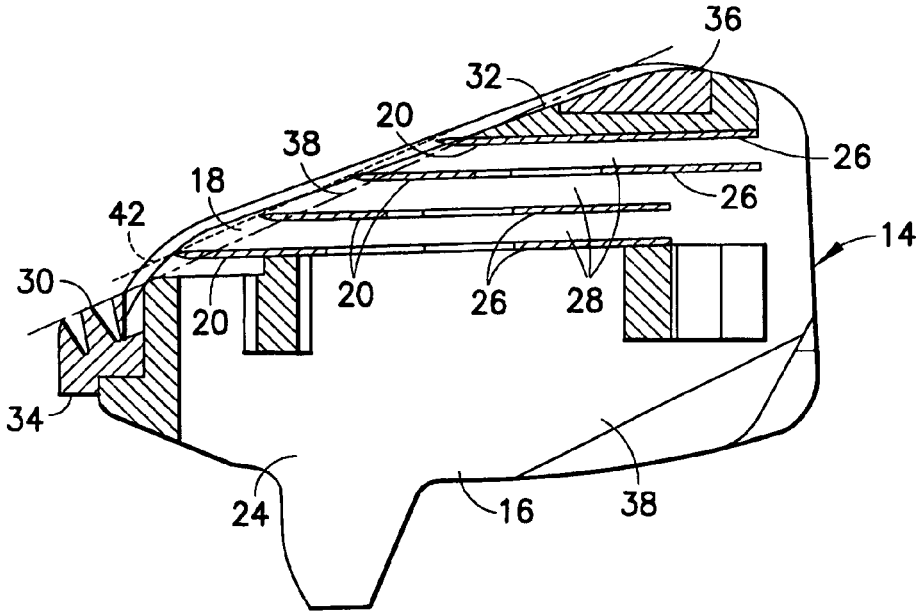
FIG. 4 is a side elevational cross-sectional view of a four-bladed razor cartridge in accordance with the present invention.
Figure 5:
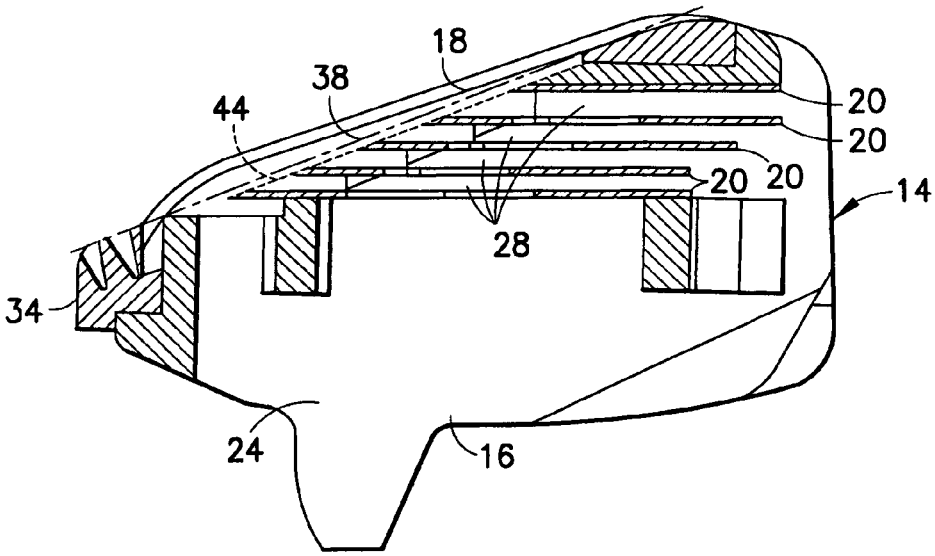
FIG. 5 is a side elevational cross-sectional view of a five-bladed razor cartridge in accordance with the present invention.

The leading surface and the trailing surface, 30 and 32 respectively, cooperate to define a contact plane 38 tangential thereto that extends across the opening 18. In the illustrated embodiment, the contact plane 38 is defined by a surface created by a series of approximately parallel lines extending between and contacting the leading surface 30 and the trailing surface 32, over the opening 18. As shown in FIGS. 4 and 5, the lines that define the contact plane 38 tangentially contact the curved leading surface 30 and the curved trailing surface 32 defining a line contact with both the leading and trailing surfaces. While a planar contact plane has been illustrated, the present invention is not limited in this regard as the contact plane 38 could be of almost any contour. For example, if the leading and trailing edges, 30 and 32 respectively, were to undulate, the contact plane 38 would also undulate.

The contact plane 38 permits the cutting edge exposure for the cutting edges 22 of each razor blade 20 to be categorized as neutral, positive, or negative. A cutting edge 22 has neutral cutting edge exposure if the entire cutting edge is on the contact plane. A cutting edge 22 has positive cutting edge exposure if any portion of the cutting edge extends through the contact plane 38. A cutting edge 22 has a negative exposure if the cutting edge neither touches, nor extends through the contact plane 38.

The base 24 includes flow members 40 positioned between successive razor blades 20 and between the razor blades and the frame 16. There may be any number of flow members 40, that can be equally or unequally spaced. The flow members 40 engage a hirsute surface at or about the contact plane 38. The flow members 40 preferably have a small tip radius of about 0.02 to 0.5 mm. However, the present invention is not limited in this regard as other radii can be employed. During a shaving operation, the flow members 40 support the hirsute surface and prevent it from entering the interstitial areas between the razor blades 20 and the razor blades and the frame 16, thereby reducing razor bum or nicking of the hirsute surface. The number and size of the flow members 40 should be selected to minimize the interference with as much of a cutting edge 22 as possible.

Referring to FIG. 4, the cutting edges 22 are positioned on a line 42 such that the cutting edges 22 have a common, positive cutting edge exposure wherein each razor blade 20 penetrates the contact plane 38. Referring to FIG. 5, the cutting edges are positioned on a line 44 such that the cutting edges 22 have a common, negative cutting edge exposure. In this case, the razor blade does not penetrate the contact plane 38.

Referring to FIGS. 6A–D several patterns of common, negative cutting edge configurations are illustrated. While FIG. 6 depicts only common, negative cutting edge configurations, it should be readily apparent that similar common, positive cutting edge configurations are possible.

Figure 6A:
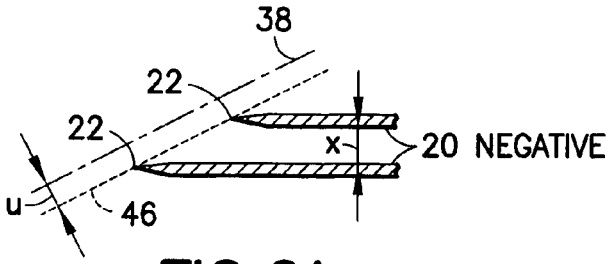
FIGS. 6A–D schematically illustrate different razor blade orientations relative to the contact plane.

In FIG. 6A, a two-blade all negative configuration is shown wherein the cutting edges 22 are positioned along a line 46 such that each cutting edge is the same distance "u" from the contact plane 38. It is preferred that the distance from contact surface to contact surface be no greater than about 0.2mm, such as between two adjacent cutting edges 22 or between a cutting edge and an adjacent surface, e.g., leading surface 34 or trailing surface 36, however, the present invention is not limited in this regard.

Figure 6B:
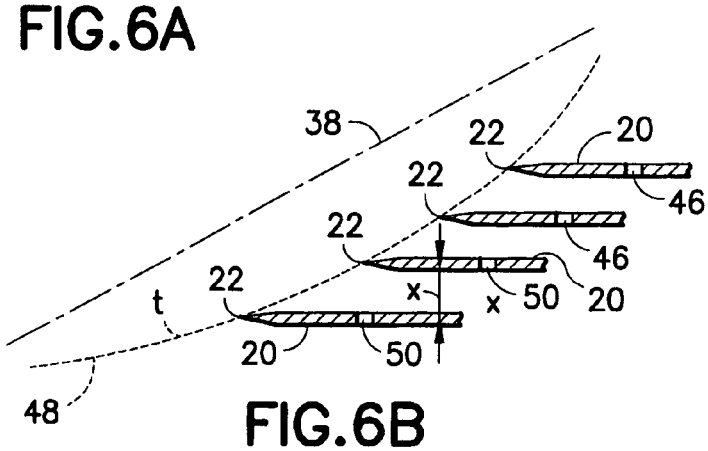

As shown in FIG. 6B a four-blade all negative configuration includes cutting edges 22 located along a line 48 that defines a fair function f(*a*). In this embodiment, the razor blades 20 are depicted as being generally parallel giving a constant separation distance x between adjacent razor blades. Separation between adjacent cutting edges 22 is preferably between 0.3, 1.0mm, and more preferably 0.5 mm. However, the invention is not limited in this regard. Separation between adjacent cutting edges 22 does not have to be uniform. Also shown in this embodiment is at least one razor blade 20 having at least one hole 50 therein to allow for the passage of fluid to assist in the removal of shaving debris that accumulates between razor blades and between a razor blade and the frame 16.

Figure 6C:
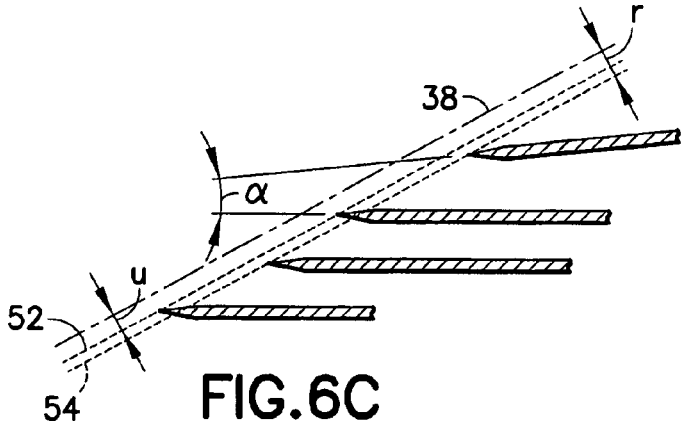

FIG. 6C shows a four-blade all negative configuration wherein two pairs of non-adjacent razor blades 20 all are the same distance u and v from the contact plane 38. One pair of cutting edges 22 is on one line 52 and the other pair is on another line 54. The first pair is off the contact plane 38 by a distance denoted by u, and the second pair is off the contact plane by a distance denoted by v. This embodiment further shows that the razor blades 20 do not necessarily have to be parallel one to the other. One of the outer razor blades 20 is skewed by an angle a relative to an adjacent razor blade. Divergence of the razor blades 20 from the cutting edge 22 assists in debris removal from between the razor blades.

Figure 6D:
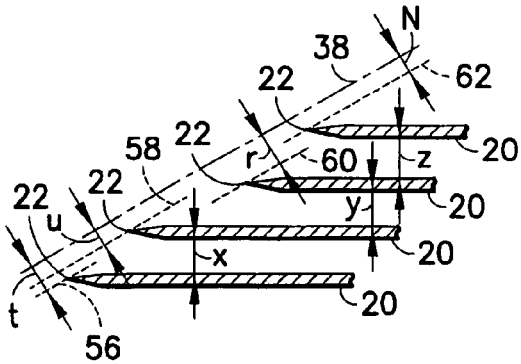

FIG. 6D shows a four-blade negative configuration wherein each cutting edge 22 is a different distance (t, u, v, w) from the contact plane 38 and has different spacing (x, y z). In this configuration, one cutting edge 22 is on a first line 56, a second cutting edge is on a second line 58, a third cutting edge is on a third line 60, and a fourth cutting edge is on a fourth line 62.

Although the present invention has been described in considerable detail with reference to certain preferred versions thereof, other versions are possible, particularly versions wherein the contact plane or razor blades are not planar, and the cutting edges have a geometry other than a line. Therefore, the spirit and scope of the invention should not be limited to the description of the preferred versions contained herein.

The invention claimed is:

1. A razor cartridge, comprising:

a frame defining a base, said frame having an opening defined in part by a leading surface and a generally opposite trailing surface, said leading surface and said trailing surface cooperating to define a contact plane tangential thereto and extending across said opening;

at least four razor blades attached to said base, said razor blades being fixedly spaced, each of said razor blades defining a cutting edge positioned at least in part in said opening, wherein each razor blade and the next adjacent razor blade define an interstitial area comprising a void extending partially along the cutting edges of the razor blades; and wherein all of said cutting edges have a cutting edge exposure relative to said contact plane that is all negative.

2. The razor cartridge of claim 1 wherein; a distance between said contact plane and a cutting edge defined by at least one of said razor blades is different from a distance between said contact plane and a cutting edge defined by the next successive blade.

3. The razor cartridge of claim 1 wherein a distance between said contact plane and said cutting edges is different for each blade.

4. The razor cartridge of claim 1 wherein a distance between said contact plane and said cuttingedges progressively increases from blade-to-blade between said leading surface to said trailing surface.

5. The razor cartridge of claim 1 wherein a distance between said contact plane and said cutting edges progressively decreases from blade-to-blade between said leading surface to said trailing surface.

6. The razor cartridge of claim 1 wherein said cutting edges adjacent said leading edge and said trailing edge define a distance from said contact plane that is less than a distance from said contact plane to said cutting edge defined by a blade positioned therebetween.

7. The razor cartridge of claim 1 wherein said blades are generally parallel.

8. The razor cartridge of claim 1 wherein said cutting edges are equally spaced relative one to the other.

9. The razor cartridge of claim 1 wherein, at least one blade is skewed relative to another blade.

10. The razor cartridge of claim 1 wherein at least one blade defines a hole therethrough.

11. A razor cartridge, comprising:

a frame defining a base, said frame having an opening defined in part by a leading surface and a generally opposite trailing surface, said leading surface and said trailing surface cooperating to define a contact plane tangential thereto and extending across said opening;

at least three razor blades attached to said base, said razor blades being fixedly spaced, each of said razor blades defining a cutting edge positioned in part in said opening, wherein each razor blade and the next adjacent razor blade define an interstitial area comprising a void extending partially along the cutting edges of the razor blades;

wherein all of said cutting edges have a cutting edge exposure relative to said contact plane that is one of all positive and all negative; and wherein a distance between said contact plane and said cutting edges progressively varies from blade-to-blade between said leading surface and said trailing surface.

12. A razor cartridge, comprising:

a frame defining a base, said frame having an opening defined in part by a leading surface and a generally opposite trailing surface, said leading surface and said trailing surface cooperating to define a contact plane tangential thereto and extending across said opening;

at least four razor blades attached to said base, said razor blades being fixedly spaced, each of said razor blades defining a cutting edge positioned at least in part in said opening, wherein each razor blade and the next adjacent razor blade define an interstitial area comprising a void extending partially along the cutting edges of the razor blades; and wherein all of said cutting edges have a cutting edge exposure relative to said contact plane that is all positive and one of all equal, all progressively increasing and all progressively decreasing.

* * * * *